US009565883B2

(12) United States Patent
Dinh

(10) Patent No.: US 9,565,883 B2
(45) Date of Patent: Feb. 14, 2017

(54) BRANCHED EYELASHES

(71) Applicant: Daniel Phu Dinh, Beverly Hills, CA (US)

(72) Inventor: Daniel Phu Dinh, Beverly Hills, CA (US)

( * ) Notice: Subject to any disclaimer, the term of this patent is extended or adjusted under 35 U.S.C. 154(b) by 0 days.

(21) Appl. No.: 14/046,371

(22) Filed: Oct. 4, 2013

(65) Prior Publication Data

US 2014/0026913 A1 Jan. 30, 2014

Related U.S. Application Data

(63) Continuation-in-part of application No. 12/584,295, filed on Sep. 2, 2009, now Pat. No. 8,752,562, which is a continuation of application No. 11/473,943, filed on Jun. 23, 2006, now Pat. No. 7,600,519.

(60) Provisional application No. 61/709,503, filed on Oct. 4, 2012.

(51) Int. Cl.
*A41G 3/00* (2006.01)
*A41G 5/02* (2006.01)

(52) U.S. Cl.
CPC ..... *A41G 5/02* (2013.01)

(58) Field of Classification Search
CPC ..... A41G 5/02
USPC ..... 132/216, 217, 53–56
See application file for complete search history.

(56) References Cited

U.S. PATENT DOCUMENTS 1,831,801 A 9/1931 Birk
1,897,719 A 2/1933 Birk
3,516,422 A 6/1970 Bechtold et al.
3,561,458 A 2/1971 Udes
3,566,889 A 3/1971 Cole et al.
3,833,007 A * 9/1974 Jacobs ..... 132/53
3,880,175 A 4/1975 Hosokawa
3,900,038 A 8/1975 Masters
3,968,807 A 7/1976 Kraicer
4,029,111 A 6/1977 Barton
4,299,242 A 11/1981 Choe
D278,086 S 3/1985 Greenberg
5,547,529 A 8/1996 Woolf
(Continued)

OTHER PUBLICATIONS

Notice of Allowance for U.S. Appl. No. 11/473,943, Date mailed: Aug. 21, 2009.

(Continued)

*Primary Examiner* — Rachel Steitz

(74) *Attorney, Agent, or Firm* — Tope-McKay & Associates

(57) ABSTRACT

A branched eyelash extension is described. In one aspect, the eyelash extension is a vertically branched/stacked eyelash extension that includes a first filament having both a first proximal end and a first distal end and a second filament having both a second proximal end and a second distal end. The proximal end of the second filament is attached on top of or below the proximal end of the first filament, such that they are collectively a vertically branched/stacked eyelash extension. In another aspect, the eyelash extension includes branches in a side-by-side configuration. In this aspect, the proximal end of the second filament is attached to the side of the proximal end of the first filament, such that they are collectively a branched eyelash extension in a side-by-side configuration.

1 Claim, 10 Drawing Sheets
(5 of 10 Drawing Sheet(s) Filed in Color)

(56) References Cited

U.S. PATENT DOCUMENTS

| | | | | |
|---|---|---|---|---|
| 6,536,445 | B2 | 3/2003 | Kuroda | |
| D510,159 | S | 9/2005 | Song | |
| 7,600,519 | B2 | 10/2009 | Dinh | |
| D632,018 | S | 2/2011 | Nguyen | |
| D632,019 | S | 2/2011 | Nguyen | |
| 8,061,367 | B2 | 11/2011 | Rabe et al. | |
| 8,113,218 | B2 | 2/2012 | Nguyen | |
| 8,127,774 | B2 | 3/2012 | Dinh | |
| 8,225,800 | B2 | 7/2012 | Byrne | |
| 2003/0005941 | A1 | 1/2003 | Iosilevich | |
| 2005/0061341 | A1 | 3/2005 | Choe | |
| 2007/0023062 | A1 | 2/2007 | McKinstry et al. | |
| 2007/0272264 | A1* | 11/2007 | Byrne | 132/201 |
| 2007/0295353 | A1 | 12/2007 | Dinh | |
| 2008/0196732 | A1 | 8/2008 | Merszei | |
| 2009/0217938 | A1 | 9/2009 | Rabe et al. | |

OTHER PUBLICATIONS

Office Action 1 for U.S. Appl. No. 11/473,943, Date mailed: Apr. 10, 2009.
Response to Office Action 1 for U.S. Appl. No. 11/473,943, Date mailed: Jun. 2, 2009.
Notice of Allowance for U.S. Appl. No. 12/584,295, Date mailed: Apr. 30, 2014.
Office Action 1 for U.S. Appl. No. 12/584,295, Date mailed: Dec. 16, 2010.
Response to Office Action 1 for U.S. Appl. No. 12/584,295, Date mailed: Apr. 13, 2011.
Office Action 2 for U.S. Appl. No. 12/584,295, Date mailed: May 31, 2011.
Response to Office Action 2 for U.S. Appl. No. 12/584,295, Date mailed: Sep. 30, 2011.
Office Action 3 for U.S. Appl. No. 12/584,295, Date mailed: Nov. 16, 2011.
Response to Office Action 3 for U.S. Appl. No. 12/584,295, Date mailed: Mar. 15, 2012.
Office Action 4 for U.S. Appl. No. 12/584,295, Date mailed: Jul. 2, 2012.
Response to Office Action 4 for U.S. Appl. No. 12/584,295, Date mailed: Sep. 20, 2012.
Office Action 5 for U.S. Appl. No. 12/584,295, Date mailed: Oct. 29, 2012.
Response to Office Action 5 for U.S. Appl. No. 12/584,295, Date mailed: Feb. 28, 2013.
Office Action 6 for U.S. Appl. No. 12/584,295, Date mailed: May 8, 2013.
Response to Office Action 6 for U.S. Appl. No. 12/584,295, Date mailed: Sep. 9, 2013.
Office Action 7 for U.S. Appl. No. 12/584,295, Date mailed: Oct. 29, 2013.
Response to Office Action 7 for U.S. Appl. No. 12/584,295, Date mailed: Mar. 31, 2014.

* cited by examiner

BRANCHED EYELASHES

CROSS-REFERENCE TO RELATED APPLICATIONS

This is a Continuation-in-Part Application of U.S. application Ser. No. 12/584,295, filed on Sep. 2, 2009, and entitled, Eyelash Extensions and Method for Applying Eyelash Extensions," which is a Continuation Application of U.S. application Ser. No. 11/473,943, filed on Jun. 23, 2006, and entitled, "Eyelash Extensions and Method for Applying Eyelash Extensions," now U.S. Pat. No. 7,600,519.

This is ALSO A Non-provisional application of U.S. Provisional Application No. 61/709,503, filed on Oct. 4, 2012, and entitled, "Branched Eyelashes."

BACKGROUND OF THE INVENTION (1) Field of Invention

The present invention relates to false eyelashes and, more particularly, to branched eyelash extensions that are branched by being attached with one another in a vertically-stacked manner or in a side-by-side manner.

(2) Description of Related Art

Beauty products have long been known in the art. Users, women in particular, have sought a variety of beauty products to enhance their aesthetic appearance. For example, blush is often used to add color to a woman's cheeks. As another example, lipstick is traditionally used to add a variety of colors and features to a user's lips. To enhance the appearance of a user's eyelashes, the user often applies mascara. Mascara is applied to the user's eyelashes to both thicken and bring color to the eyelashes.

As an alternative to mascara, a user can apply adhesive-backed false eyelashes. The adhesive-backed false eyelashes typically consist of a tape-like material with a plurality of eyelashes affixed thereto. The tape-like material can be applied to the user's eyelid to add the appearance of thick and full eyelashes.

A problem with adhesive-backed false eyelashes is that they typically do not look natural and because of their bulk, cannot be worn comfortably for extended periods of time.

Therefore, there is a continuing need for eyelash extensions that look natural and that can be worn comfortably for extended periods of time. Further traditional eyelash extensions are provided as single eyelashes. Although single eyelash extensions are viable, it may be desirable in some aspects to provide fuller eyelashes. Thus, a continuing need exists for eyelash extensions that provided added fullness.

SUMMARY OF INVENTION

The present invention relates to false eyelashes and, more particularly, to branched eyelash extensions that are branched by being attached with one another in a vertically-stacked manner or in a side-by-side manner.

In one aspect, the eyelash extension is a vertically branched/stacked eyelash extension that includes a first filament having both a first proximal end and a first distal end and a second filament having both a second proximal end and a second distal end. The proximal end of the second filament is attached on top of or below the proximal end of the first filament, such that they are collectively a vertically branched/stacked eyelash extension. In another aspect, the eyelash extension includes branches in a side-by-side configuration. In this aspect, the proximal end of the second filament is attached to the side of the proximal end of the first filament, such that they are collectively a branched eyelash extension in a side-by-side configuration.

In another aspect, the first and second filaments are formed of the same colors or, in yet another aspect, different colors such that the first filament is a different color than the second filament.

In yet another aspect, the first proximal end is attached with the second proximal end so that the roots of adjacent filaments are attached with one another.

In another aspect, the first proximal end is attached with the second filament between the second proximal and distal ends such that the roots of adjacent filaments are offset with respect to one another.

Finally, as can be appreciated by one in the art, the present invention also comprises a method for forming and using the branched eyelash extensions described herein.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The objects, features and advantages of the present invention will be apparent from the following detailed descriptions of the various aspects of the invention in conjunction with reference to the following drawings, where.

DETAILED DESCRIPTION

Figure 1:
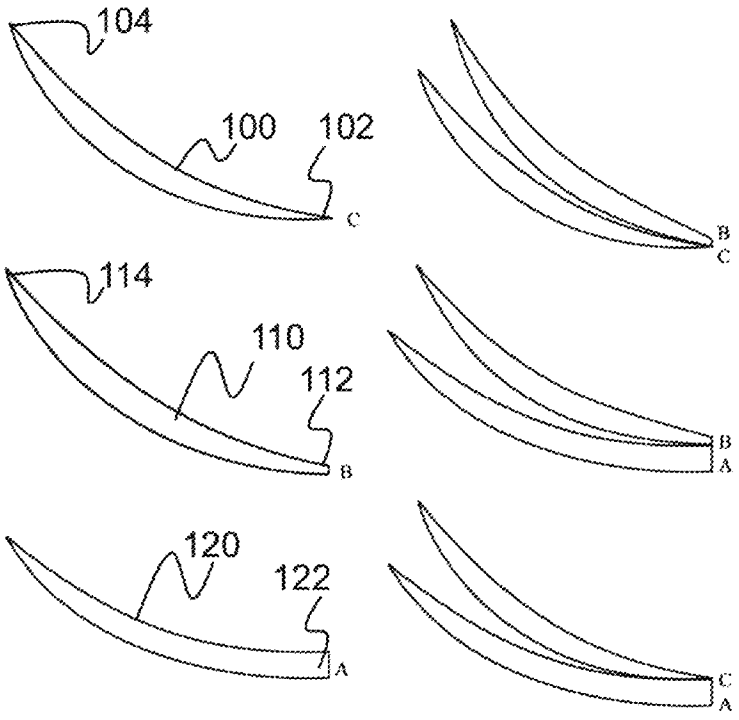
FIG. 1 is a side-view illustration depicting several example combinations by which filaments can be vertically branched or stacked to form branched eyelashes according to the principles of the present invention.

The present invention relates to false eyelashes, and more particularly to branched eyelash extensions that are branched on top of one another, in a vertically-stacked manner and, in another aspect, in a side-by-side manner. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

If used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

In order to enhance the beauty of a user's eyelashes, users have traditionally applied adhesive-backed false eyelashes. As an improvement over the prior art, the present invention describes eyelash extensions that can be applied individually and directly to a user's eyelashes. More specifically, the present invention is directed to branched eyelash extensions that are branched by filaments that are attached with one another in a vertically-stacked manner or in a side-by-side manner.

For example and in one aspect as illustrated in the side-view illustrations of FIG. 1, the present invention is directed to artificial branched eyelash extensions that are formed such that individual filaments are stacked vertically. For example, in one aspect, the invention includes at least a first filament 100 having a first proximal end 102 and a first distal end 104 and second filament 110 having both a second proximal end 112 and a second distal end 114. In this aspect, the proximal end 112 of the second filament 110 is attached on top of or below the proximal end 102 of the first filament 100, such that they are collectively a vertically branched/stacked eyelash extension. It should be understood that the filaments can be formed in any suitable shape, non-limiting examples of which include a tapered (C) proximal end 102, a tapered-cut (B) proximal end 112, or blunt (C) proximal end 122. It should also be understood that the various filaments can be stacked on top of or below one another in any combination and in any desired number. Several non-limiting examples of stacked combinations are depicted as filaments with shapes B over C, or B over A, or C over A. It should be understood that these specific examples are provided as non-limiting examples and that the various combinations can be reversed, switched, or otherwise combined in any stacked manner with any other shaped filament according to the principles of the present invention.

Figure 2:
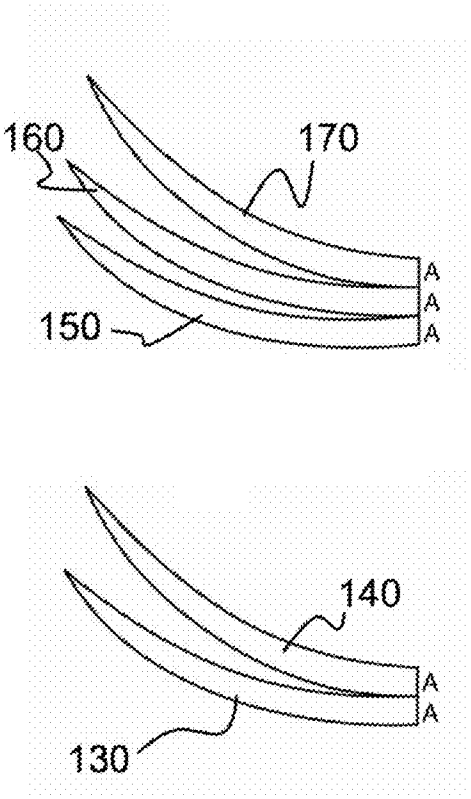
FIG. 2 is a side-view illustration depicting several example combinations by which filaments can be vertically branched or stacked to form branched eyelashes according to the principles of the present invention.
Figure 3:
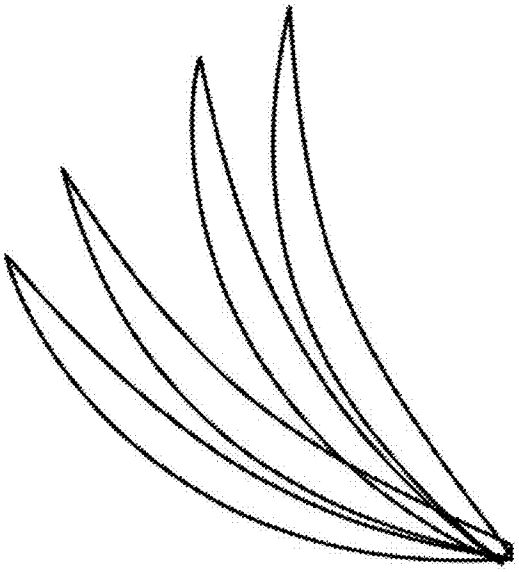
FIG. 3 is a side-view illustration depicting several example combinations by which filaments can be vertically branched or stacked to form branched eyelashes according to the principles of the present invention.

In other words and as depicted in the examples, the branch or multiple branches are stacked on top of one another in a vertical manner, as opposed to be attached side-by-side. It should also be noted that the branched eyelash extensions can be formed of any number of attached filaments, so long as it is more than one filament that is affixed with another filament. For example, depicted in FIG. 2 is an example with a first filament 130 and a second filament 140, which creates two stacked filaments. As another example, a first filament 150 is combined with a second 160 and third 170 filament, which creates a branched eyelash extension with three-stacked filaments. Thus, it should be understood that any number of stacked filaments, in any shape and any combination, can be attached with one another to form a branched eyelash extension according to the principles of the present invention. For example, the side-view illustration of FIG. 3 illustrates four stacked eyelash extensions. In this non-limiting example, two filaments are attached on top of other two filaments to form the four stacked eyelash extensions.

Figure 4:
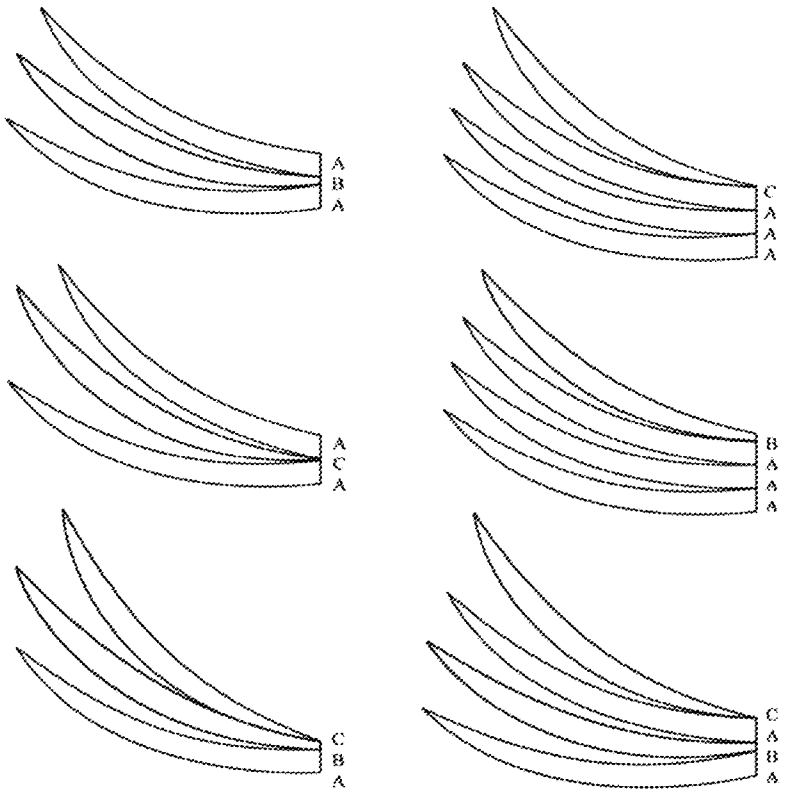
FIG. 4 is a side-view illustration depicting several example combinations by which filaments can be vertically branched or stacked to form branched eyelashes according to the principles of the present invention.

Several additional non-limiting examples are depicted in the side-view illustrations of FIG. 4. As shown in FIG. 4, there are several variations of the proximal ends of the filaments, non-limiting examples of which are depicted as tapered (C), a tapered-cut (B), and blunt (A) proximal ends. While FIG. 2 illustrated several examples of filaments with blunt (A) proximal ends attached with one another in a vertical manner, FIG. 4 provides additional non-limiting examples, depicting filaments with at least one tapered (C) or a tapered-cut (B) proximal end as being vertically attached with a filament(s) having a blunt (A) proximal end. As shown, the filaments can be attached with one another in any combination, order, and/or number.

Figures 5A, 5B, 5C:
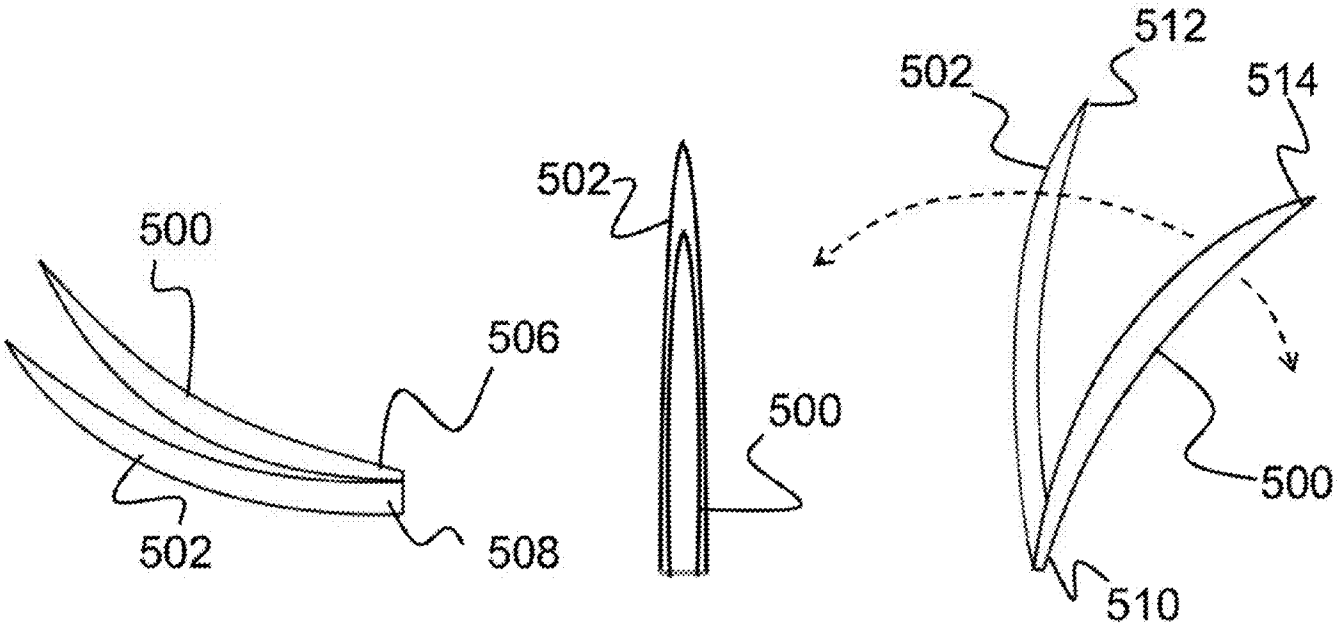
FIG. 5A is a side view illustration of two filaments vertically stacked such that their proximal ends are attached with one another according to the principles of the present invention.
FIG. 5B is a top-view illustration of two filaments, showing the filaments attached such that they are in substantial lateral or horizontal alignment with respect to one another according to the principles of the present invention.
FIG. 5C is a top-view illustration of two filaments, showing the filaments attached at the proximal end, with their distal, ends separated laterally according to the principles of the present invention.

The filaments can also be attached with one another so that the horizontal relationship between the filaments is set at any desired configuration. For example, FIG. 5A is a side view illustration of two filaments 500 and 502 vertically stacked such that their proximal ends 504 and 506 are attached with one another. Although the side-view illustration of FIG. 5A illustrates the vertical relationship between the two filaments 500 and 502, it does not illustrate the lateral relationship. For further understanding, FIG. 5B is a top-view illustration of the two filaments 500 and 502, showing the filaments attached such that they are in substantial lateral or horizontal alignment with respect to one another. Alternatively, FIG. 5C is a top-view illustration of the two filaments 500 and 502, showing the filaments attached at the proximal end 510, with their distal ends 510 and 512 separated laterally. In this aspect (as shown in FIG. 5C), the filaments 500 and 502 are offset or angled with respect to one another such that they are not in substantial alignment (as shown in FIG. 5B). It should be understood that the filaments (i.e., any desired number) can be attached with one another such that they have any spacing or angle between the lateral or horizontal alignment and the distal ends of the filaments. This is further illustrated in FIG. 8.

Figure 6:
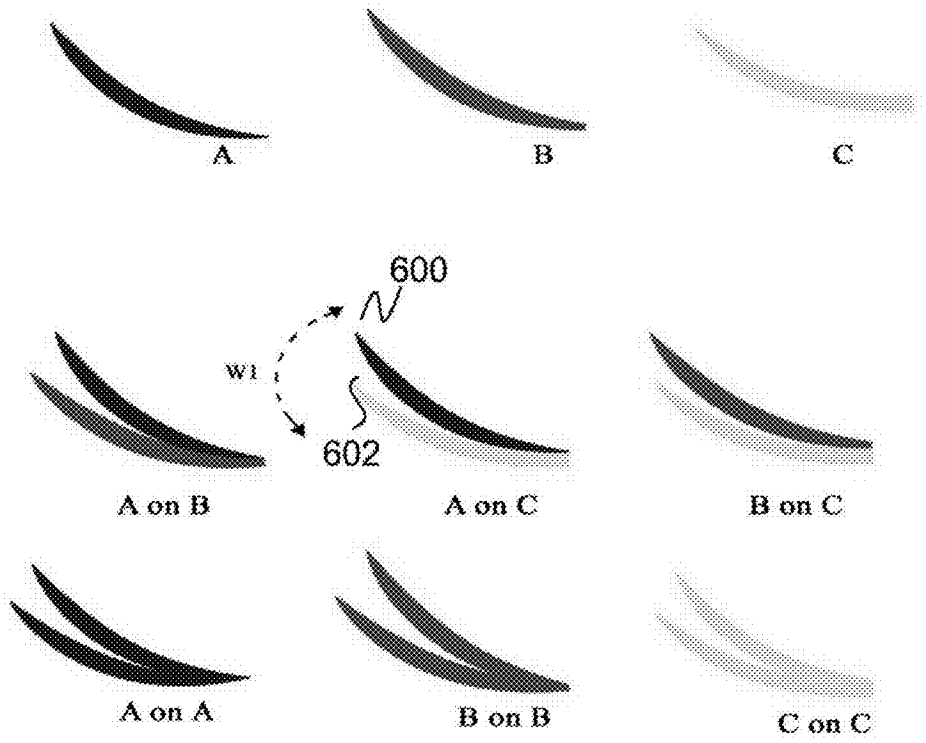
FIG. 6 is a side-view illustration of examples of various combinations of filament shapes and colors that can be attached with one another to form a branched eyelash extension according to the principles of the present invention.

Further, the branched eyelash extensions can be formed in any suitable number, shape, length, width, thickness, and height. Further and as shown in FIG. 6, the branched eyelash extensions can be formed in any color tone. For example, FIG. 6 provides a side-view illustration of several non-limiting examples of various combinations of filament shapes and colors that can be attached with one another to form a branched eyelash extension according to the principles of the present invention. In this side view-illustration, W1 is the height (W1) between the distal ends 600 and 602 of two vertically stacked filaments that collectively form a branched eyelash extension. It should be understood that the filaments can be formed with any desired flare (the same or different between the filaments) and/or attached with one another at any desired angle to alter the height W1 between the distal ends 600 and 602 of adjacently attached filaments.

Figure 7:
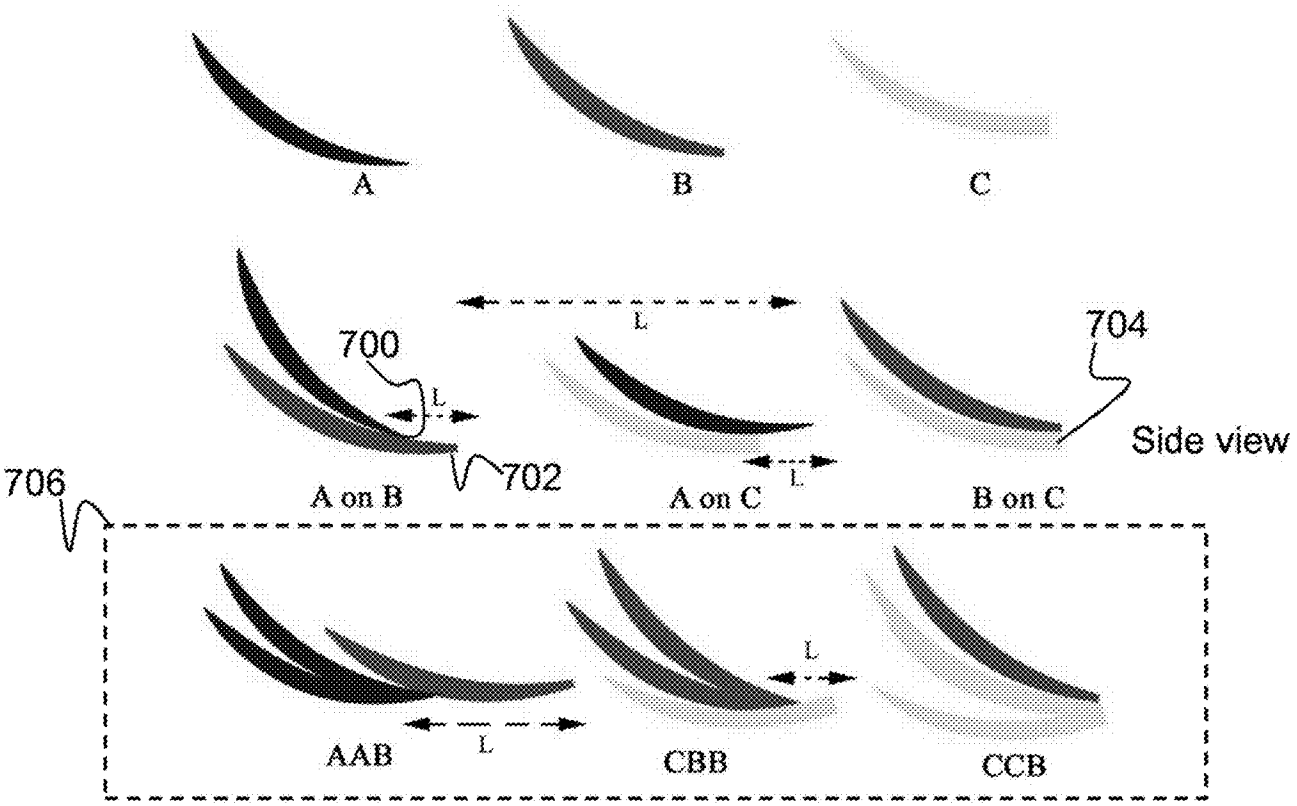
FIG. 7 is a side-view illustration of examples of various combinations of filaments of various shapes and colors, illustrating forward and reverse spacing of the proximal ends of adjacent filaments according to the principles of the present invention.

As shown in FIGS. 1 through 6, the proximal ends (i.e., roots) of adjacent filaments are attached directly to one another. However, it should be understood that the present invention is not intended to be limited thereto as the spacing of the roots can be varied to any desirable location. For example and as depicted in FIG. 7, the spacing of the attachment points of the roots (i.e., proximal ends) of the filaments can varied to any desired degree or location. This aspect also applies to the side-by-side aspect described in further detail below.

As shown in the side-view illustrations of FIG. 7, L is the lateral or forward and reverse spacing of the proximal ends 700 and 702 of adjacent filaments. As shown, the filaments can be attached with one another at any suitable point along their length to alter L. For example, in one aspect, the proximal ends 700 and 702 are attached with one another so that L is zero or minimal, as depicted by the filaments at element 704. Alternatively, the top or bottom filament can be slid forward or back with respect to the other and attached together such that the proximal ends 700 and 702 are not attached directly with one another, thereby altering L. It should be understood that although FIG. 7 provides several non-limiting examples, the invention is not intended to be limited thereto as the filaments can be attached with respect to one another in any combination of shapes, colors, and attachment points (to alter L), as desired. As another example, when there are three or more filaments, as depicted in box 706, the filaments can be attached with one another such the proximal ends (i.e., roots) are attached in alignment with one another or in any combination to alter L as desired. For example, the roots can alternate, be equal, etc. Thus, one filament can be attached at any desired location with respect to an adjacent filament, such as being attached halfway between the top and side of another filament, or at the end or any combination thereof. They can also be formed and/or attached to flare to any degree, both vertically and laterally.

Figure 8:
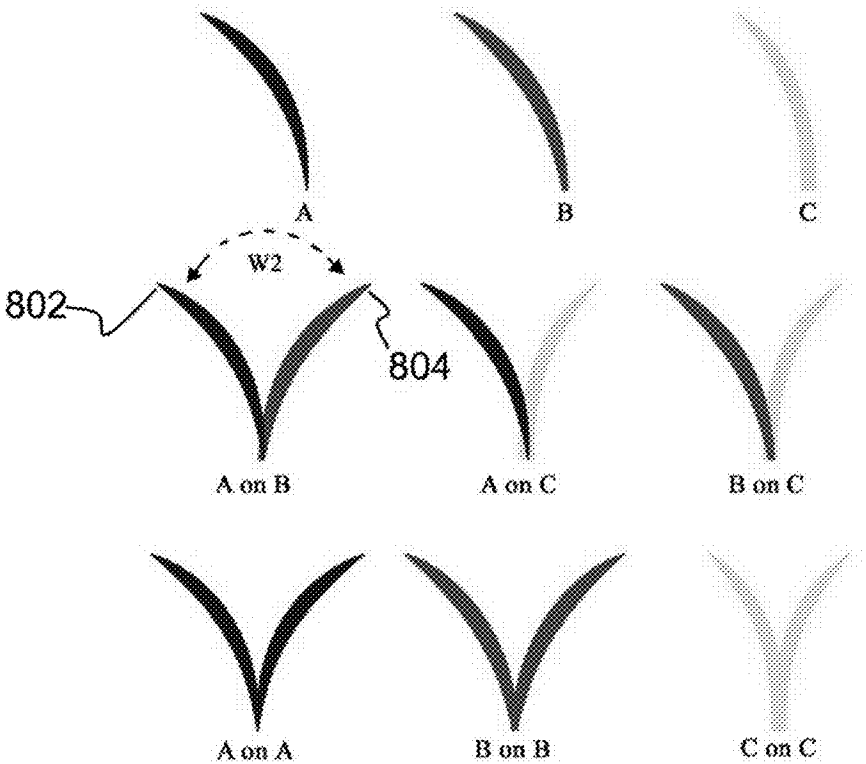
FIG. 8 is a top-view illustration of examples of various combinations of filaments of various shapes and colors, illustrating that adjacent filaments can be attached with one another to form any desired width between distal ends of adjacent filaments.

Additionally and as show in FIG. 8, the branched eyelash extensions can be formed such that the distance W2 between distal ends 800 and 802 is set at any desired width. FIG. 8 is a top-view illustration that depicts a configuration of the vertically stacked filaments in which adjacent filaments are offset with one another (similar to FIG. 5C). In other word, adjacent filaments can be formed or attached with one another such that W2 is set at any desired width, from being aligned vertically to being separated by any degree, such as 20 degrees, 45 degrees, etc.

It should also be noted that the branched eyelash extensions can be formed in a single piece or formed by actually stacking and/or attaching multiple eyelash extensions (i.e., filaments) to one another. In either case, the root can be cut, tapered, tapered cut or formed in any shape (bolt, hole (e.g., similar to the hand needle for sewing-the eye of the needle), horn, etc.). If formed by stacking and attaching multiple eyelash extensions, the roots can be tapered, tapered cut, cut bluntly, or cut or shaped in any desired shape, or any combination thereof.

Figure 9:
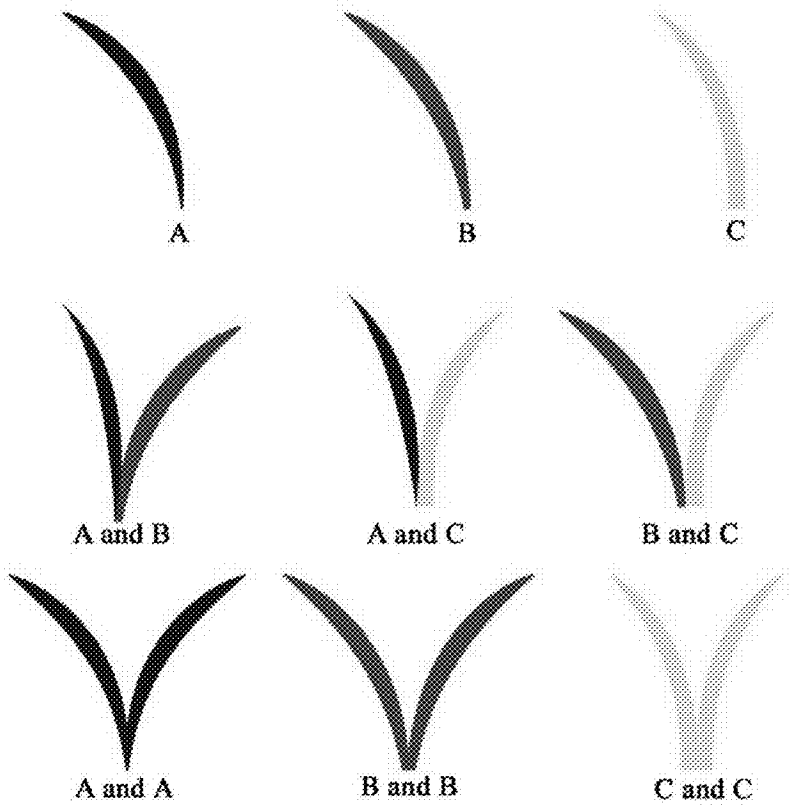
FIG. 9 is a top-view illustration of examples of various combinations of filament shapes and colors that can be attached with one another in a side-by-side manner to form a branched eyelash extension according to the principles of the present invention.
Figure 10:
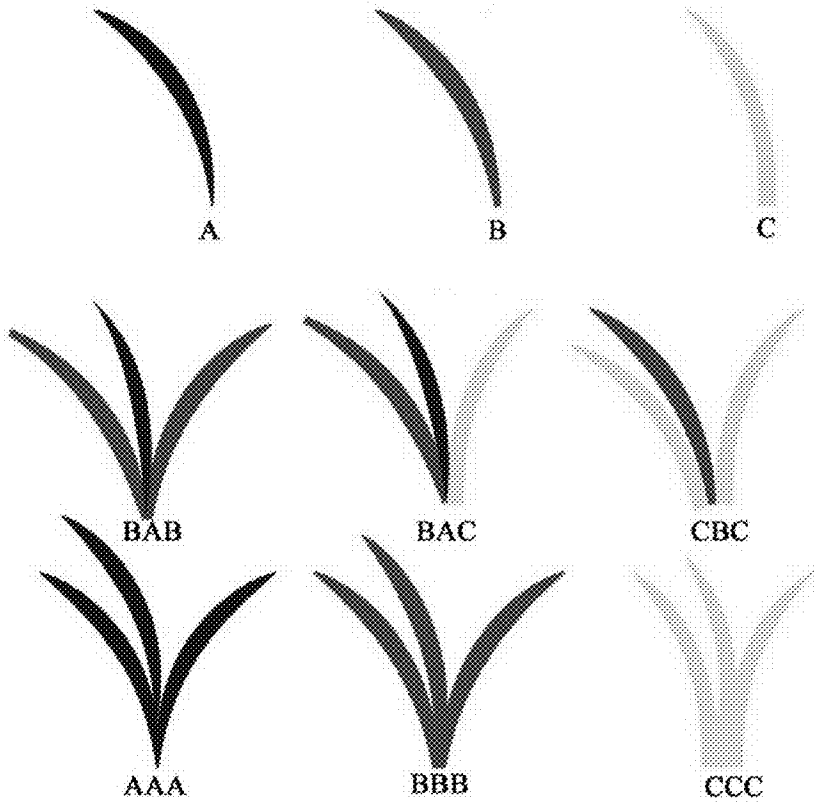
FIG. 10 is a top-view illustration of examples of various combinations of filament shapes and colors that can be attached with one another in a side-by-side manner to form a branched eyelash extension according to the principles of the present invention.

FIGS. 9 through 10 provide top-view Illustrations to depict another aspect of the present invention, in which the eyelash extensions (i.e., filaments) are attached with one another in a side-by-side manner, as opposed to be attached on top of one another as show in FIGS. 1 through 8. As shown, some eyelash extension filaments have tapered ends (e.g., filament A), others have tapered-cut ends (e.g., filament B), and others have blunt cut-ends (e.g., filament C). In this aspect, the filament ends or roots (either tapered, tapered-cut, cut, or any shapes of the roots (bolt, hole (look like the hand needle for sewing the eye of the needle), horn, etc.) are merged together in a side-by-side manner, or in any combination thereof. They can be adhered to one another as was the case above or merged or formed in a single process. As was also the case above, they can be attached in a side-by-side manner in any suitable number (more than one lash), shape, color (e.g., one color or multiple colors on a single filament and/or one color or different colors on different filaments, etc.), width, flare, etc. Further, the side-by-side branched eyelash extensions can be in any number and shape, so long as it is more than one filament attached with another. They can be filaments of the same shape (e.g., A and A) or various shapes (e.g., A and B, B and A, A and C, C and A, C and B, B and C, etc.), or any number and/or combination thereof.

For example, FIG. 10 is a top-view illustration depicting various non-limiting examples of combinations of three filaments that are attached in a side-by-side manner. Thus, the present invention is directed to branched eyelash extensions that are formed of a plurality of filaments that are attached in either a vertically stacked manner (i.e., on top of one another) or in a side-by-side manner (or any combination or variation thereof, such as at an angled or twisting up from the side to the top, etc.). The branched eyelash extensions are formed of filaments in any number, shape, color, width, height, length, and root stacking pattern. It should also be noted that these variables can be the same or different amongst each of the individual filaments in the branched eyelash extension. Thus, each layer of the branched eyelash extension is a filament that is attached on top of or below, or to the side of or across another filament, according to the invention described herein. Each branch in the side-by-side configuration is a filament that can be on the left or right of the other filament. Each of the filaments can be attached in a single formation or molding process, or they can be separately formed and attached using any suitable technique, non-limiting examples of which include using an adhesive such as eyelash glue.

It should be understood that FIGS. 1 through 10 illustrate branched eyelash extensions according to the present invention and do not illustrate the user's natural lashes. Thus, the images synthetic branched eyelashes (e.g., eyelash extensions) that are used to affix with a user's natural eyelashes. Finally, it should be understood that all of the variations and aspects described herein can be applied to either of the vertically stacked or side-by-side branched eyelashes.

What is claimed is:

1. A branched eyelash extension for applying to an eyelash, comprising:

at least a first filament attached directly to a second filament to form a branched eyelash extension;

wherein the first filament includes both a first proximal end and a first distal end and the second filament includes both a second proximal end and a second distal end; and wherein the second proximal end of the second filament is attached with the first filament at a point between the first proximal end and the first distal end such that a gap exists between the first proximal end and the second proximal end, with the second filament attached on top of the first filament to form a vertically stacked eyelash extension.

* * * * *